US011155957B2

(12) United States Patent
Alipour

(10) Patent No.: US 11,155,957 B2
(45) Date of Patent: Oct. 26, 2021

(54) SAFETY COVER FOR STEAM IRON SOLE PLATE

(71) Applicant: Ehsan Alipour, San Rafeal, CA (US)

(72) Inventor: Ehsan Alipour, San Rafeal, CA (US)

( * ) Notice: Subject to any disclaimer, the term of this patent is extended or adjusted under 35 U.S.C. 154(b) by 158 days.

(21) Appl. No.: 16/510,699

(22) Filed: Jul. 12, 2019

(65) Prior Publication Data

US 2020/0018014 A1 Jan. 16, 2020

Related U.S. Application Data

(60) Provisional application No. 62/697,233, filed on Jul. 12, 2018.

(51) Int. Cl.
*D06F 75/38* (2006.01)

(52) U.S. Cl.
CPC ..... *D06F 75/38* (2013.01)

(58) Field of Classification Search
CPC ..... D06F 75/38; D06F 75/40; D06F 79/00; D06F 79/02; D06F 79/023; D06F 79/026; D06F 81/00; D06F 83/00
USPC ..... D32/73, 68, 71
See application file for complete search history.

(56) References Cited

U.S. PATENT DOCUMENTS

D153,350 S * 4/1949 Gelb ..... D06F 79/02 D32/73
2,659,989 A * 11/1953 Cone ..... D06F 75/16 38/77.4
2,990,635 A * 7/1961 Rogers ..... D06F 75/38 38/97
3,905,138 A * 9/1975 Abolafia ..... D06F 75/38 38/97
4,128,918 A * 12/1978 Wenk ..... F16L 33/035 24/16 R
4,209,921 A * 7/1980 Kochauf ..... D06F 75/20 38/97
D336,700 S * 6/1993 Riemann ..... D06F 75/16 D32/71
5,987,788 A * 11/1999 Doyel ..... D06F 75/38 38/97
6,226,904 B1 * 5/2001 Brady ..... D06F 79/00 38/95
6,250,593 B1 * 6/2001 Palu ..... D06F 79/02 248/117.2

(Continued)

OTHER PUBLICATIONS amazon.com, Bringsine-Silicone-Ironing-Board-Resistant, Jul. 4, 2019, pp. 1-8.

*Primary Examiner* — Ismael Izaguirre
(74) *Attorney, Agent, or Firm* — GSS Law Group; Gregory Scott Smith; Phillip Wagner

(57) ABSTRACT

A sole plate cover covers all exposed surfaces of a steam iron's sole plate to contain fluids leaking from the iron and prevent injury from contact with hot surfaces. The flexible cover includes a plate formed with a plurality of vent holes, a side wall extending outward from the plate all the way around the perimeter of the sole plate, a vent plug extending out from the plate to block a steam vent on the sole plate, and flanges configured to hold the cover to the front and rear ends of the sole plate. A sole plate cover may include a flexible strap for holding closed a water tank cover on the iron. An optional pressure relief valve on the strap blocks a vent hole on the water tank to prevent leakage, opening in the event of an over-pressure condition in the tank.

18 Claims, 21 Drawing Sheets

(56) References Cited

U.S. PATENT DOCUMENTS

| | | | | |
|---|---|---|---|---|
| 6,499,519 | B1 * | 12/2002 | Brown | D06F 75/38 150/161 |
| 2010/0071235 | A1 * | 3/2010 | Pan | D06F 79/02 38/141 |

* cited by examiner

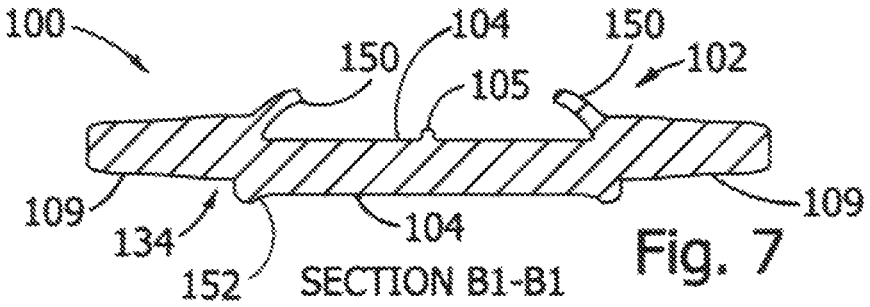
SECTION B1-B1 Fig. 7
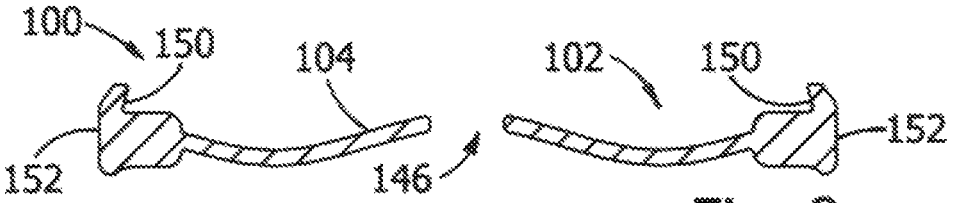
SECTION B2-B2 Fig. 8
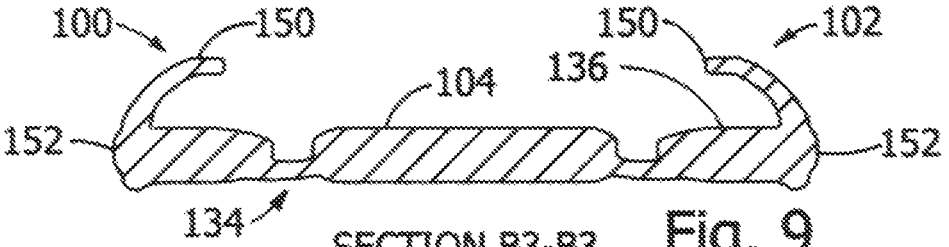
SECTION B3-B3 Fig. 9
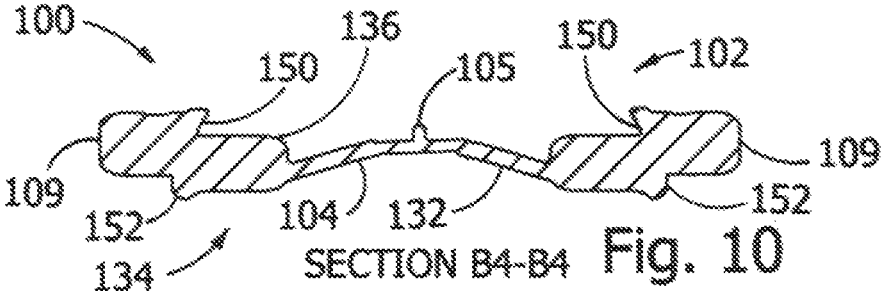
SECTION B4-B4 Fig. 10
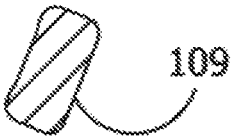
SECTION B5-B5 Fig. 11

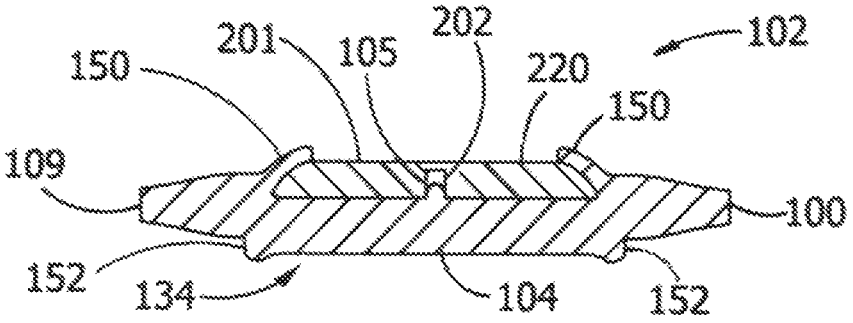
ALTERNATIVE SECTION B1-B1 Fig. 12
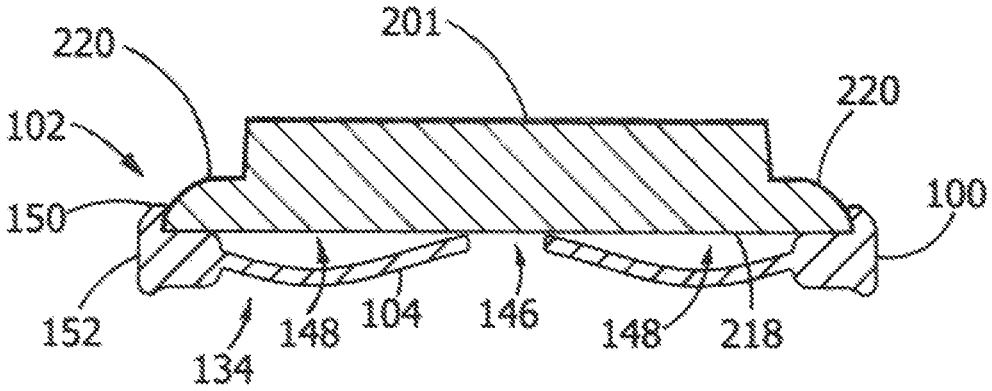
ALTERNATIVE SECTION B2-B2 Fig. 13
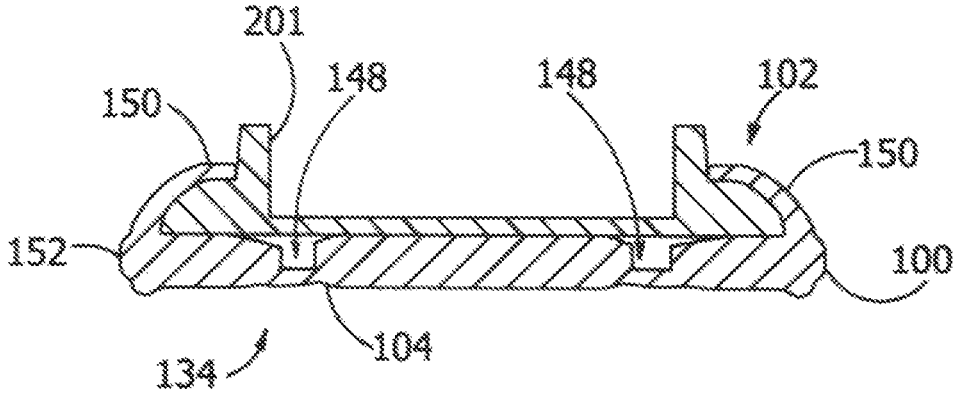
ALTERNATIVE SECTION B3-B3 Fig. 14

ALTERNATIVE SECTION B4-B4

ALTERNATIVE SECTION B4-B4

DETAIL E
CLOSED POSITION

ALTERNATIVE POSITION
DETAIL E

SECTION D-D
CLOSED POSITION

ALTERNATIVE SECTION D-D
OPEN POSITION

SAFETY COVER FOR STEAM IRON SOLE PLATE

CROSS REFERENCE TO RELATED APPLICATIONS

This application claims the benefit of U.S. Provisional Application No. 62/697,233 filed Jul. 12, 2018, titled "Fabric Care Accessory Device", incorporated herein by reference in its entirety.

FIELD OF THE INVENTION

Embodiments are related to apparatus for preventing contact with a hot sole plate on a steam iron used for pressing clothes.

BACKGROUND

A clothes iron for removing wrinkles from clothing may be configured as a handheld electric appliance with a polished sole plate heated by a thermostatically-controlled heating element. The sole plate may be formed with one or more steam vents through which hot water vapor may be directed onto a clothing article being ironed. A clothes iron configured for releasing hot water vapor may be referred to as a steam iron. Liquid water from a water tank in fluid communication with the steam vents can be heated by the heating element and forced out of the steam vents by the pressure of the heated water vapor.

The sole plate of a steam iron may be heated to a temperature above the boiling point of water. For example, the sole plate may be heated to a temperature in a range from about 220 degrees Fahrenheit (104 degrees Celsius) to about 450° F. (232° C.) according to the design of the iron, a flow rate or temperature of steam desired, and the properties of the fabric being ironed. A heated sole plate may be sufficiently hot to scorch fabric or cause injury to a person coming into contact with the polished bottom, side walls, and exposed top edges or surfaces of the sole plate. Liquid water may be released through the steam vents whether or not the steam iron is turned on. Liquid water and steam leaking from the steam vents may be hot enough to injure a person after the iron is turned off. Liquid water and steam leaking from the steam vents and/or water tank in a steam iron may carry scale or other contaminants that can stain clothing or other articles placed in contact with the iron, even after the iron cools. After turning the steam iron off, it may be difficult to judge how long to wait until the sole plate has cooled enough to safely store the iron without risk of burning a person or scorching an object the iron comes into contact with.

SUMMARY

An example embodiment of a sole plate cover for a steam iron includes a flexible plate; a flexible sidewall extending outward from the flexible plate; a front sole plate retaining flange attached to a front end of the flexible sidewall; a rear sole plate retaining flange attached to a back end of the flexible sidewall; and a vent plug extending outward from a storage side of the flexible plate. The vent plug is preferably positioned to block a steam vent on a sole plate of a steam iron.

An embodiment of a sole plate cover may optionally include any one of more of the following, singly or in any combination or subcombination: a cord wrap projection extending outward from the flexible sidewall, a hanging loop extending outward from the flexible sidewall; a flexible strap attached to the flexible sidewall, and/or a pressure relief valve attached to the flexible strap, the pressure relief valve positioned to block a water tank vent aperture formed in the steam iron.

The flexible side wall may optionally include a sole plate grip positioned to contact a top surface of the sole plate. The flexible side wall may entirely surround the outer exposed edges of the top and bottom sides of the sole plate. The flexible plate may entirely cover the entire polished bottom surface of the sole plate.

The flexible plate may be formed with a storage side and a resting side, at least one of which is formed as an undulating surface from a plurality of flexible domes and/or ridges. The vent plug on the storage side may extend out from a ridge or dome.

A method embodiment includes the steps of inserting a front end of a sole plate for a steam iron between a flexible plate and a front sole plate retaining flange on a sole plate cover; and inserting a corner at a back end of the sole plate between the flexible plate and a rear plate retaining flange on the sole plate cover.

BRIEF DESCRIPTION OF THE DRAWINGS

FIG. 7 is a lateral cross-sectional view B1-B1 showing some details of the flexible plate, flexible side wall, and sole plate grip. A position and viewing direction of cross-section B1-B1 is marked with a line B1-B1 in FIG. 2.

FIG. 8 is a lateral cross-sectional view B2-B2 showing some details of the flexible plate, flexible side wall, sole plate grip, and vent apertures. A position and viewing direction of cross-section B2-B2 is marked with a line B2-B2 in FIG. 2.

FIG. 9 is a lateral cross-sectional view B3-B3 showing some details of the flexible plate, flexible side wall, and sole plate grip. A position and viewing direction of cross-section B3-B3 is marked with a line B3-B3 in FIG. 2.

FIG. 10 is a lateral cross-sectional view B4-B4 showing some details of the flexible plate, flexible side wall, flexible dome, and vent plug. A position and viewing direction of cross-section B4-B4 is marked with a line B4-B4 in FIG. 2.

FIG. 11 is a cross-sectional view B5-B5 through a cord wrap projection. A position and viewing direction of cross-section B5-B5 is marked with a line B5-B5 in FIG. 2.

FIG. 12 is an alternative cross-sectional view B1-B1 showing an example of the sole plate captured by the sole plate grips and the vent plug blocking a steam vent in the sole plate.

FIG. 13 is an alternative cross-sectional view B2-B2 showing an example of the sole plate captured by the sole plate grips extending onto a top surface of the sole plate.

FIG. 14 is an alternative cross-sectional view B3-B3 showing an example of the sole plate grips covering the top surface of the sole plate and the flexible plate covering the bottom polished surface of the sole plate, with examples of voids or air gaps formed between the undulating surface of the flexible plate and the sole plate.

FIG. 17 further shows an example of an electric power cord for the steam iron wrapped around the cord wrap projections to store the cord.

DESCRIPTION

An example apparatus embodiment, referred to herein as a sole plate cover, is configured with a storage side for removable attachment to the sole plate of a steam iron. The storage side of the sole plate cover prevents contact between the sole plate and persons or external objects, reducing a risk of injury to persons near the iron and reducing a risk of heat damage to objects that may come into contact with a hot sole plate. A resting side of the sole plate cover provides a stable, convenient location for resting a hot iron. Side walls extending out from the storage side of the sole plate cover include flanges and other features for securely holding the cover to the sole plate while permitting easy removal of the cover when desired. Flanges and undulations on the resting side opposite the storage side reduce the contact area between the cover and the hot soleplate, and apertures passing through the storage and resting sides provide ventilation for cooling airflow. One or more vent plugs extending outward from the storage side fit into steam vents in the sole plate, blocking the steam vents sufficiently to prevent more than a trace of liquid water and/or water vapor from leaking from the steam vents when the iron is being stored. Pressure relief features in the sole plate cover prevent excessive pressure building in the steam passages and water tank in the steam iron.

Embodiments of a sole plate cover are particularly well suited for use with travel irons. A person using a travel iron may have insufficient time to wait for a hot iron to cool down before placing the iron in luggage or a carry bag. The thermal barrier and leak prevention features of the example sole plate cover embodiments may prevent injury to the person using the iron, heat damage to luggage or objects placed in close proximity to the iron, and damage or discoloration caused by water vapor and/or liquid leaking from the water storage tank and steam vents in the iron.

Figure 1:
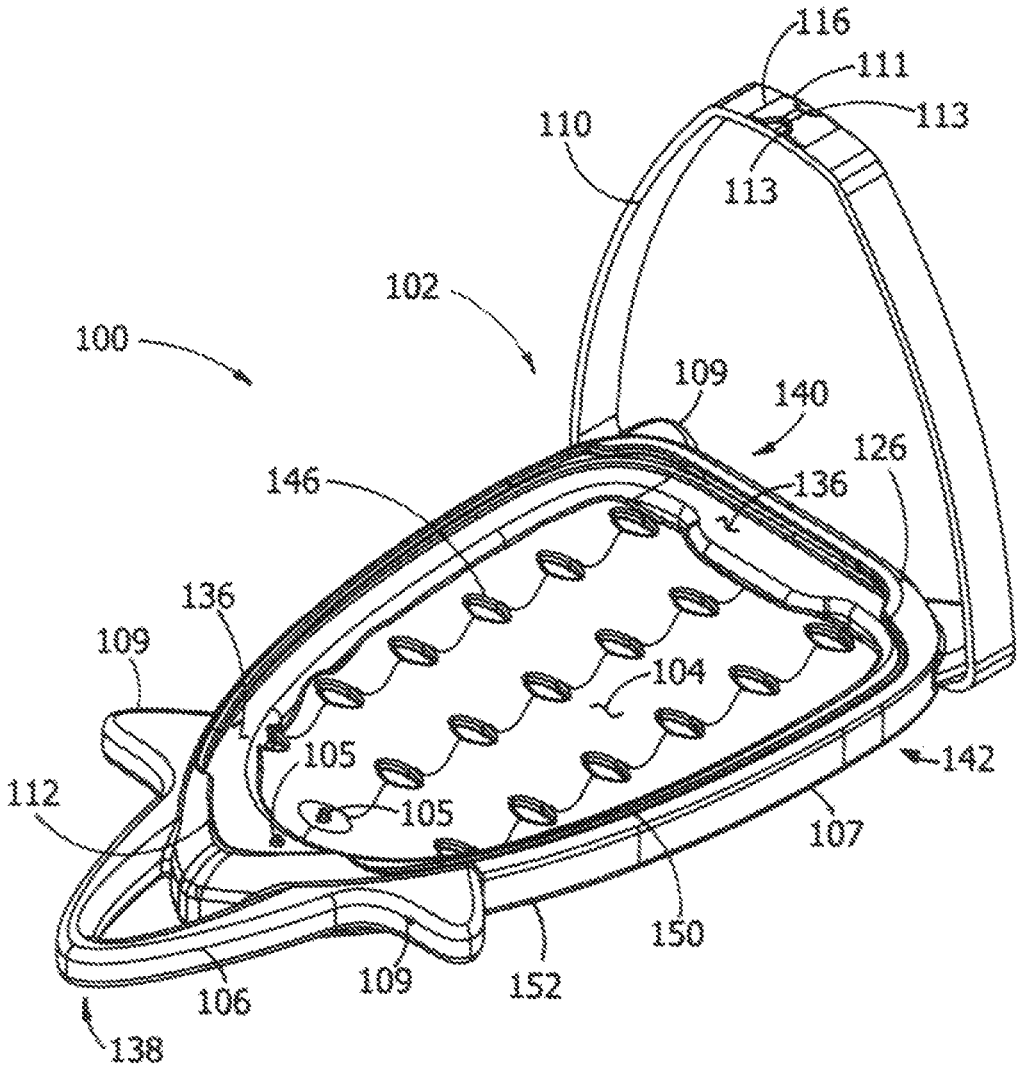
FIG. 1 shows a pictorial view toward front, left, and storage side of an example embodiment of a sole plate cover.
Figure 2:
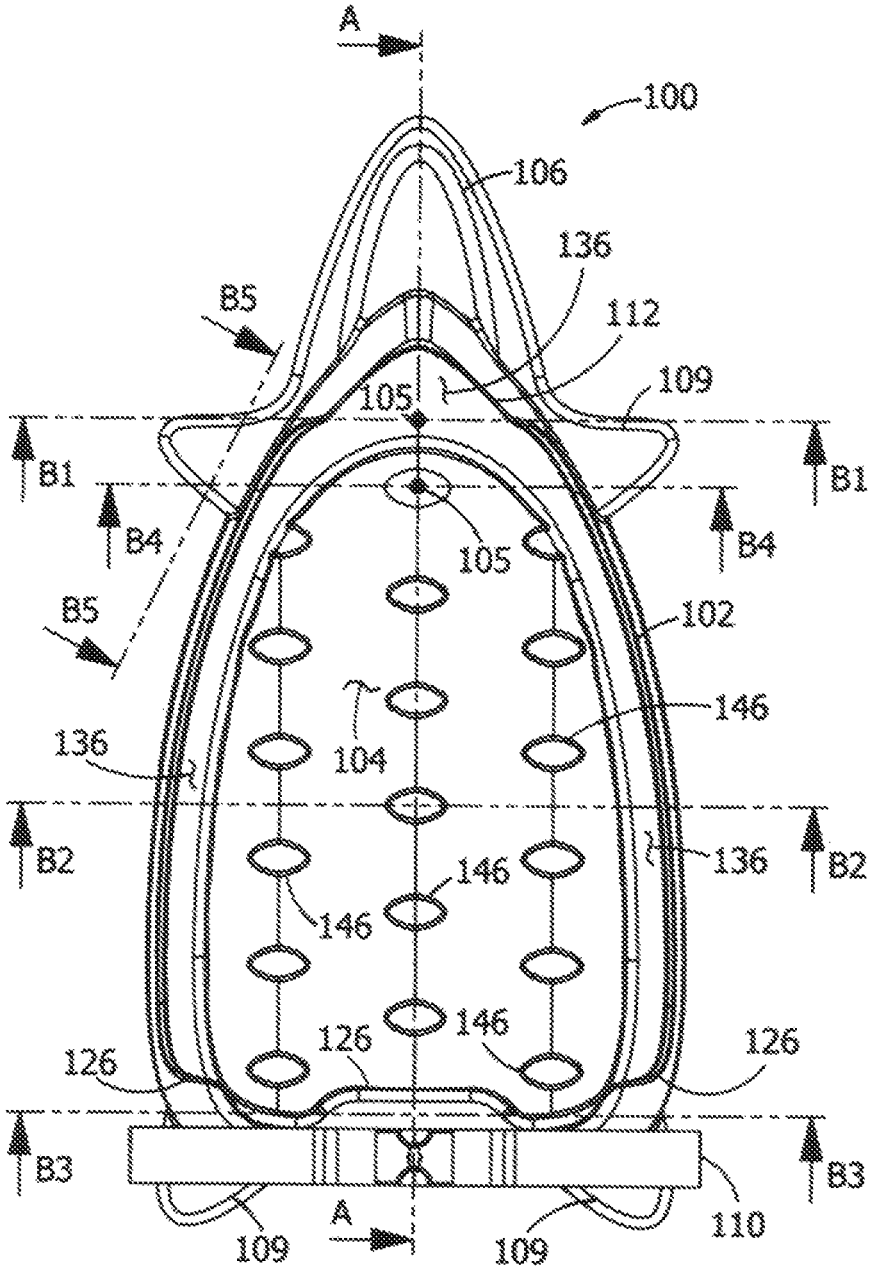
FIG. 2 shows a view toward the storage side of the example of a sole plate cover from FIG. 1.

FIG. 1 shows a pictorial view toward the front end 138, left side, and storage side 102 of an example embodiment of a sole plate cover 100. FIG. 2 shows the example of a sole plate cover 100 in a view toward the storage side 102. When the example embodiment 100 is attached to the sole plate of a steam iron, the sole plate cover 100 covers all parts of the sole plate that a person might accidentally come into contact with, including the polished bottom of the sole plate, the sides of the sole plate, and upper edges and the portion of the top surface of the sole plate that are exposed when the iron is in use. Embodiments of a sole plate cover 100 include a flexible plate 104 surrounded by a side wall 152 extending outward (upward in the view of FIG. 1) from the perimeter of the flexible plate. The side wall 152 preferably entirely surrounds the outer perimeter of the sole plate on the steam iron. A flexible front sole plate retaining flange 112 near the front end 138 and flexible rear sole plate retaining flanges 126 at opposite rear corners (142, 144) wrap onto the top surface of the sole plate, holding the sole plate against the flexible plate 104. A curved flange, also referred to as a flexible sole plate grip 150, extends inward from the side wall 152, enabling the side wall to extend onto and hold the top surface of the sole plate. The flexible sole plate grip 150 extends around the inner perimeter of the side wall, although the sole plate grip 150 may optionally be interrupted where the front and rear sole plate retaining flanges (112, 126) are located. The top surface of the sole plate is opposite the polished bottom surface of the sole plate.

The polished bottom surface of the sole plate is held securely against a flat perimeter surface 136 on the storage side 102 of the flexible plate 104 by the front sole plate retaining flange 112, the rear sole plate retaining flanges 126, and the sole plate grip 150 on the side wall 152. A plurality of through-holes 146, also referred to as vent apertures 146, are formed in the flexible plate 104, passing from the storage side 102 to the resting side 134 of the flexible plate. Cooling airflow may pass in and out of the vent apertures when the sole plate is attached to the storage side 102 of the sole plate cover 100.

At least one, and optionally more than one, steam vent plug 105 extends outward from the storage side 102 of the flexible plate 104. Each steam vent plug 105 is positioned to block, and optionally fit into, a corresponding steam vent on the sole plate of a steam iron. The steam vent plug 105 prevents water vapor and liquid water from leaking out of the steam vent when the iron is attached to the storage side of the sole plate cover.

An optional hanging loop 106 or hanging hook may extend outward from the front end 138 of the side wall 152. From one to four optional cord wrap projections 109 may extend laterally outward from the side wall 152. Two of the cord wrap projections may be positioned near the front end 138. Two more cord wrap projections 109 may be positioned at the back end 140, one cord wrap projection 109 a rear corner 142 and another cord wrap projection near an opposite rear corner 144. One or more cord warp projections may alternatively be attached to the sole plate cover 100 in locations other than those shown in the illustrated examples. Some cord wrap projections may extend outward in directions other than shown in the examples.

Some embodiments of a sole plate cover 100 include a flexible strap 110 positioned near the back end 140 of the flexible plate 104. The flexible strap 110 is positioned to pass over a water tank cover on a steam iron attached to the storage side 102, holding the water tank cover closed when the sole plate cover 100 and the attached steam iron are suspended from the hanging loop 106. An optional pressure relief valve 111 attached to the strap 110 is positioned to seal a vent hole formed in the water tank cover of the steam iron. A flexible web 116 operates as a spring and as a fluid seal, holding movable parts of the pressure relief valve 111 in position to seal the vent hole in the water tank cover, and enabling the pressure relief valve to open a path to the atmosphere through vent apertures 113 in the web 116 and other parts of the relief valve 111 when excessive pressure builds up in the steam iron's water storage tank.

The optional strap 110 may be attached to the sole plate cover 100 so as to pass over a water tank cover near the back end of the iron. The flexible strap 110 may alternatively be positioned on the sole plate cover to pass over a water tank near the front end of a steam iron. The flexible strap 110 may be attached to a side wall 152 or may alternatively be attached to a cord wrap projection 109, the storage side 102 of the flexible plate 104, a sole plate retaining flange (112, 126) or other locations on the sole plate cover 100. In some embodiments 100, the flexible strap is formed integrally with the sole plate cover. Alternatively, the flexible strap may be attached by adhesive, welding, rivets, and the like. A flexible strap 110 may optionally be configured to be easily removed and re-attached to a sole plate cover, for example by snaps, hook-and-loop fastener, insertion of part of the strap through a slot or hole in the sole plate cover, and so on.

An embodiment of a sole plate cover 100 may optionally include a visual indicator of surface temperature to indicate when the sole plate cover is cool enough for a person to touch without discomfort. The visual temperature indicator 107 may be positioned on the sidewall 152, on a sole plate retaining flange (112, 126), the flexible plate 104, or elsewhere on the sole plate cover 100. Examples of a visual temperature indictor include, but are not limited to, a thermometer and a material with reversible thermochromic properties. Examples of a material with reversible thermochromic properties include, but are not limited to, an encapsulated liquid crystal, an encapsulated leuco dye, and a thermochromic plastic.

Figure 3:
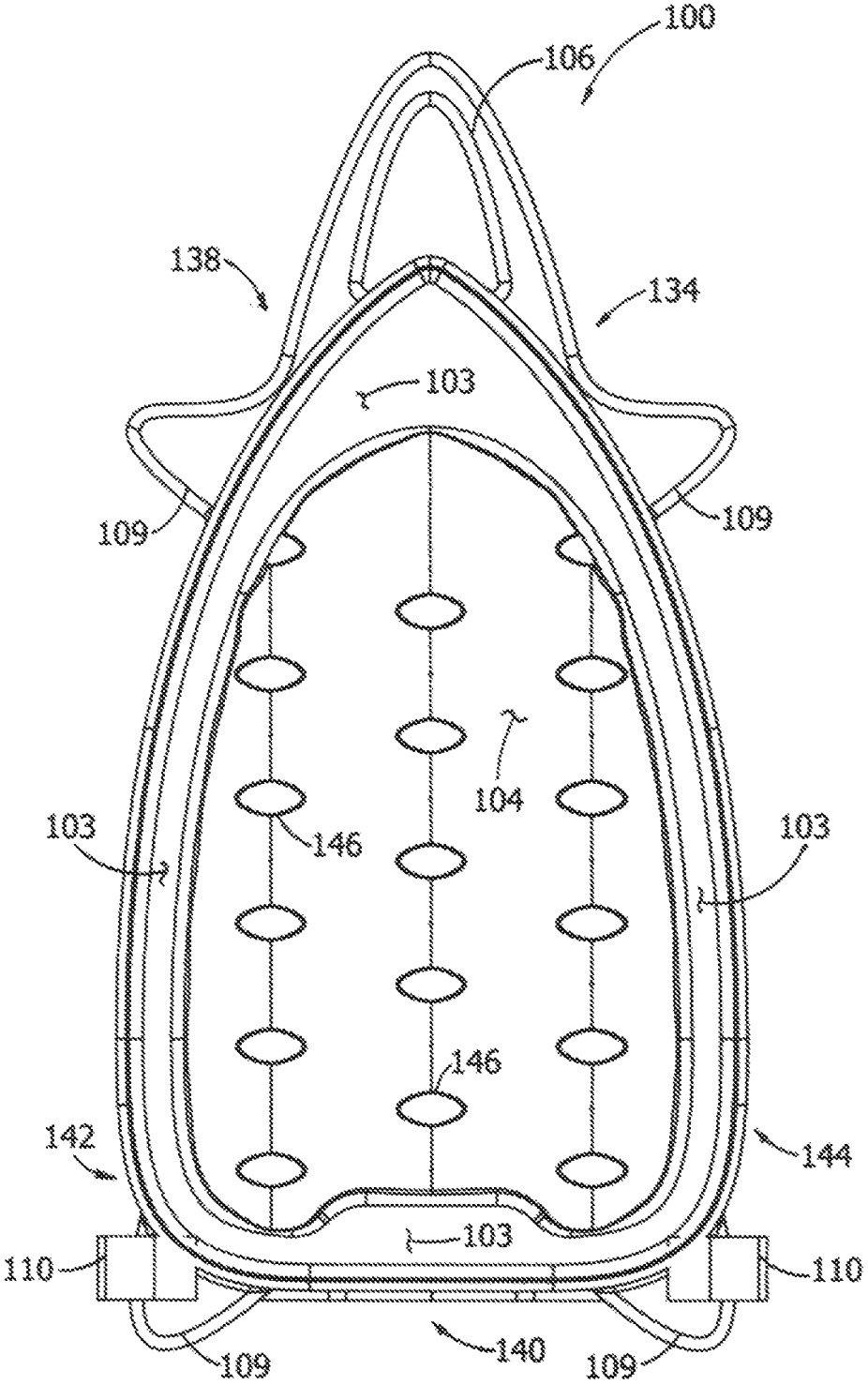
FIG. 3 shows an example of a rest side of the sole plate cover of FIG. 1, where the rest side is opposite the storage side.
Figure 4:
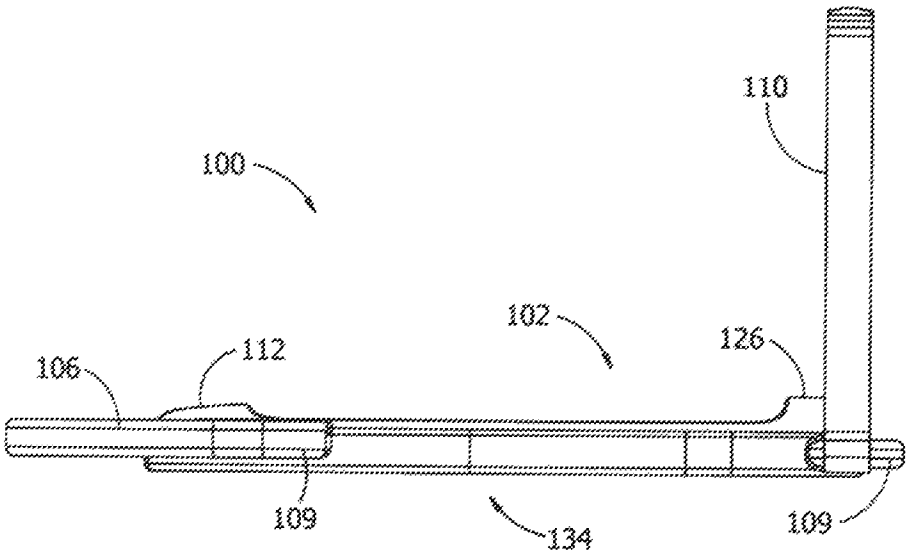
FIG. 4 is a view toward the left side of the example sole plate cover of FIG. 1.
Figure 5:
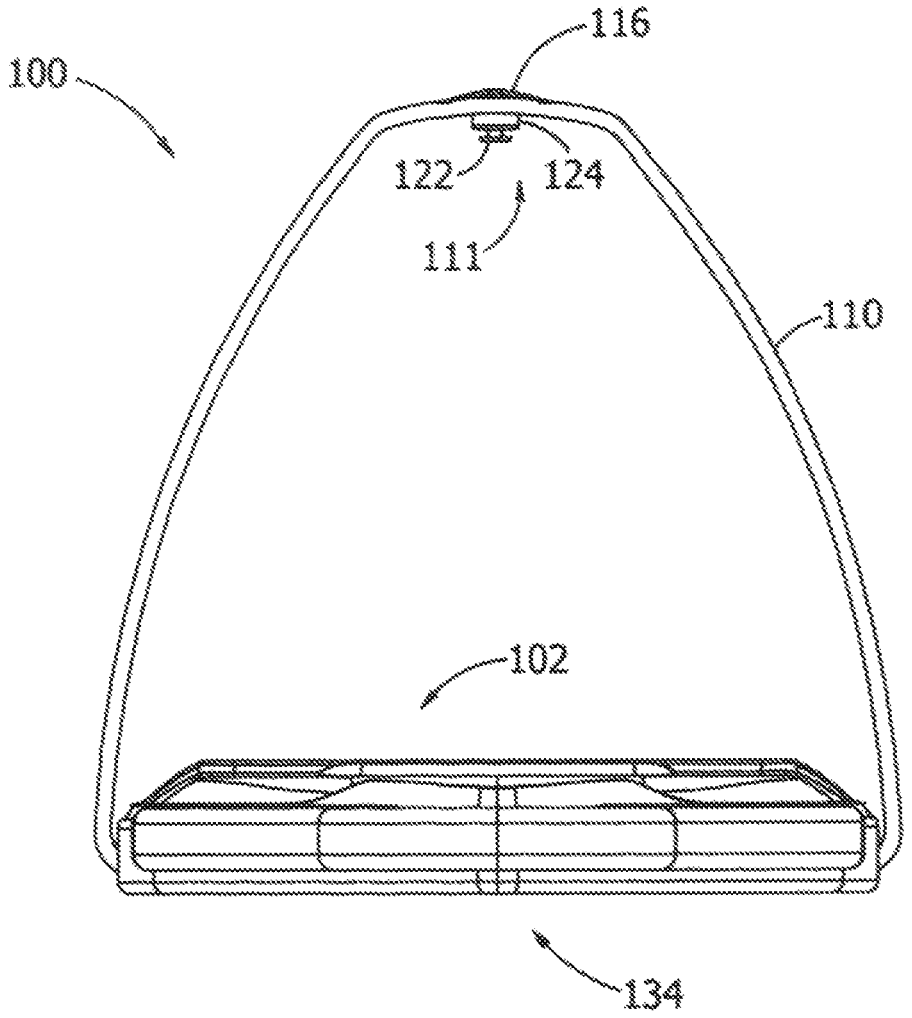
FIG. 5 is a view toward the front end of the example sole plate cover of FIG. 1.

The side of the flexible plate opposite the storage side 102 may optionally be configured as a resting side 134 for a hot steam iron. The resting side 134 supports the iron without attaching to the sole plate, providing a safe, stable surface upon which a hot iron may be placed, for example while repositioning an article being ironed. The steam iron may be placed sole-plate-down on a sole plate flange 103 extending around the perimeter of the resting side 134 of the flexible plate 104. An example of a resting side 134 with a sole plate flange 103 is shown in FIG. 3. The example of a sole plate cover 100 from the previous figures is shown again in a side view in FIG. 4 and a view toward the front end 138 in FIG. 5.

Figure 6:
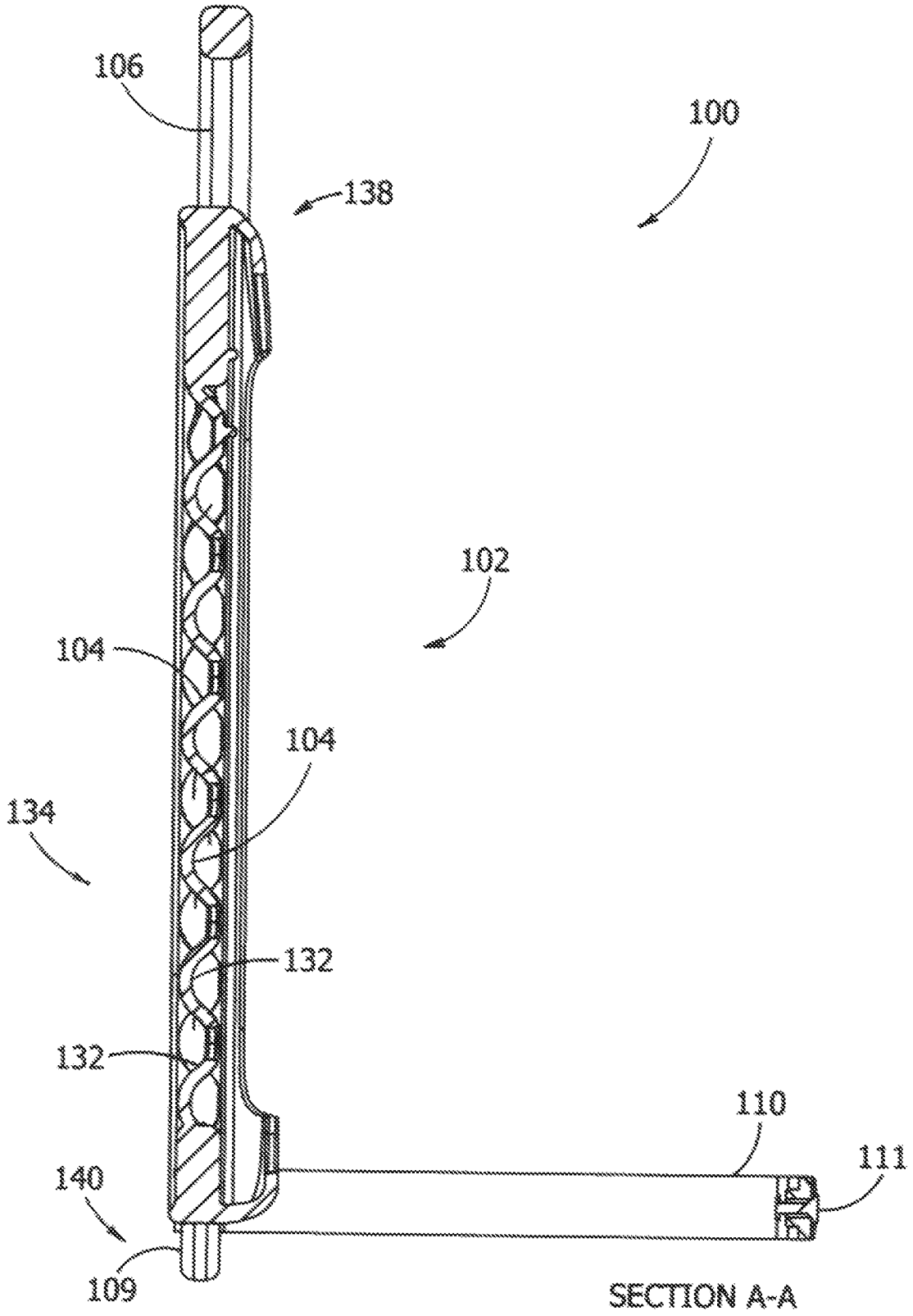
FIG. 6 is a longitudinal cross-sectional view A-A showing some details of the undulating surfaces, sole plate retaining flanges, and optional pressure relief valve. A position and viewing direction of cross-section A-A is marked with a line A-A in FIG. 2.

Examples of some details of the flexible plate 104 and pressure relief valve 111 are shown in a longitudinal cross-sectional view A-A in FIG. 6. As indicated by the serpentine outlines in the cross-section of the flexible plate 104, the flexible plate may be formed with undulating external surfaces on the storage side 102 and resting side 134. The undulating surfaces may comprise a plurality of flexible ridges 132 or may alternatively be formed from a plurality of flexible domes 132. The undulating surfaces reduce an area of contact between a sole plate on an iron and the sole plate cover 100, separating contact patches between the sole plate and sole plate cover by air gaps or voids 148 (ref. FIG. 13). Reducing the contact area between the sole plate and the sole plate cover may reduce a magnitude of conductive heat flow through the sole plate cover 100.

FIGS. 7, 8, 9, and 10 show examples of some features of the sole plate cover 100 in cross-sectional views. Section B1-B1 in FIG. 7 shows an example of a steam vent plug 105 extending outward from the storage side 102 of the flexible plate 104. FIG. 7 further shows an example of the flexible sole plate grip 150 shaped to hold the outer peripheral edges and top surface of the sole plate against the flexible plate 104. Section B2-B2 in FIG. 8 shows an example of a vent aperture 146 passing from the storage side 102 of the flexible plate 104 to the resting side 134. FIG. 8 further illustrates a change in the shape of the sole plate grip 150 in the vicinity of the cross-section, the shape of the sole plate grip modified along its length to fit closely to the arcuate sides of the sole plate as the sides converge to the pointed front end 210 of the sole plate 201. Section B3-B3 in the example of FIG. 9 shows how the sole plate grips 150 extend to reach onto the top surface of the sole plate. Section B4-B4 in FIG. 10 shows an example of a vent plug 105 extending outward from a flexible dome 132 on the storage side 102 of the flexible plate 104.

As suggested in cross-section B5-B5 in the example of FIG. 11, a cord wrap projection 109 may be formed with a solid core. A cord wrap projection 109 may be formed as an integral part of the side wall 152 or may alternatively be attached by adhesive or thermal fusion.

FIGS. 12, 13, and 14 show alternative cross-sectional views of the flexible plate and side wall with an example of a sole plate being held securely against the sole plate cover 100. Alternative section B1-B1 shows an example of a steam vent plug 105 inserted into and blocking leakage of water vapor and liquid water from an example of a steam vent 202 in a soleplate 201. The flexible sole plate grips 150 wrap around the outer peripheral edges of the sole plate, pressing against the top surface 220 of the sole plate 201 and holding the sole plate securely against the storage side of the flexible plate.

Alternative section B2-B2 in the example of FIG. 13 shows the sole plate grip 150 pressing against the top surface 220 of the sole plate 201 with the sole plate held against the storage side of the flexible plate 104. In some locations on the flexible plate voids or air gaps 148 are formed between the storage side of the sole plate cover 100 and the bottom surface 218 of the sole plate 201 to reduce the contact area between the sole plate and sole plate cover.

Alternative section B3-B3 in the example of FIG. 14 shows the sole plate grips 150 extending upward and inward from the side wall 152. FIG. 14 shows another example of voids or air gaps 148 formed between the undulating surface of the flexible plate and the bottom surface of the sole plate.

Figure 15:
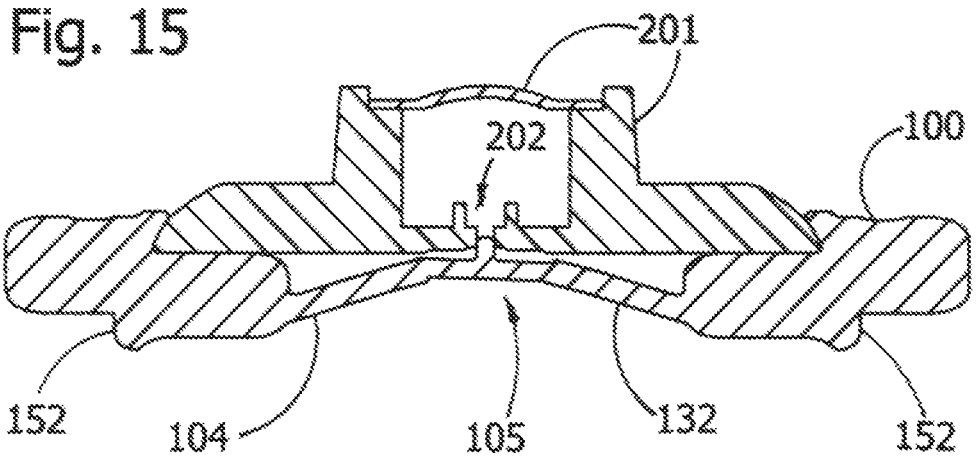
FIG. 15 shows an alternative cross-sectional view B4-B4 with an example of a vent plug in position to block fluid leakage from a steam vent in the sole plate.
Figure 16:
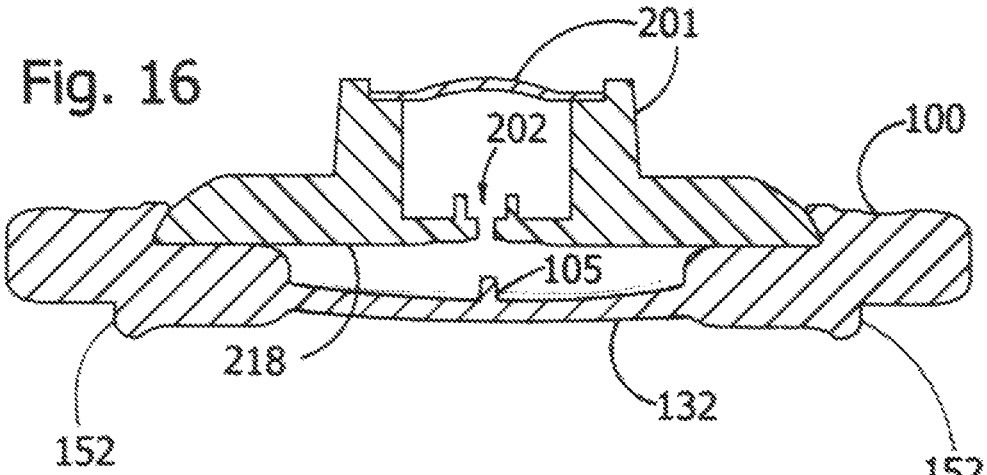
FIG. 16 shows an another alternative cross-sectional view B4-B4 with an example of the flexible dome displaced away from the sole plate and the vent plug displaced away from the steam vent in response to a high pressure condition in the steam iron.

Examples of a steam vent plug positioned to prevent fluid leakage from a steam vent in a sole plate are shown in the cross-sectional views of FIG. 15 and FIG. 16. In the example of FIG. 15, alternative cross-sectional view B4-B4 illustrates an example of a steam vent plug 105 inserted into a steam vent 202 in a sole plate 201. The steam vent plug preferably fits into the steam vent with a close sliding fit to provide an effective seal against water vapor and liquid water leaking from the iron through the steam vent 202. In the event that excessive pressure to builds up inside the iron, the flexible dome 132 to which the steam vent plug 105 is attached flexes away from the sole plate under the influence of vapor pressure from the iron's steam vent, pulling the steam vent plug away from the steam vent 202 and enabling pressure inside the steam iron to fall.

Figure 17:
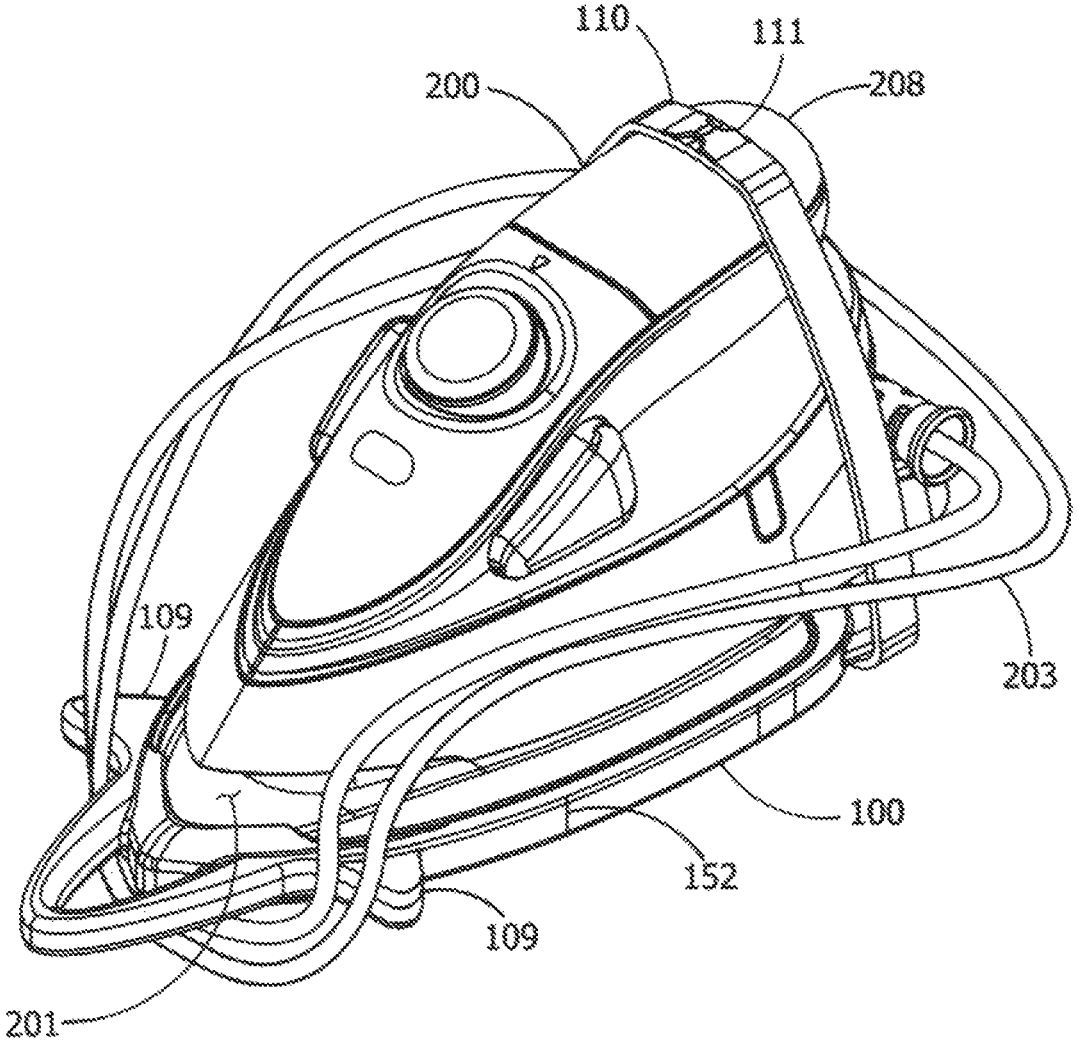
FIG. 17 shows a pictorial view of an example embodiment of a sole plate cover attached to the sole plate of an example steam iron by flanges at the front and rear of the cover and by sole plate grips along the side walls of the cover.
Figure 18:
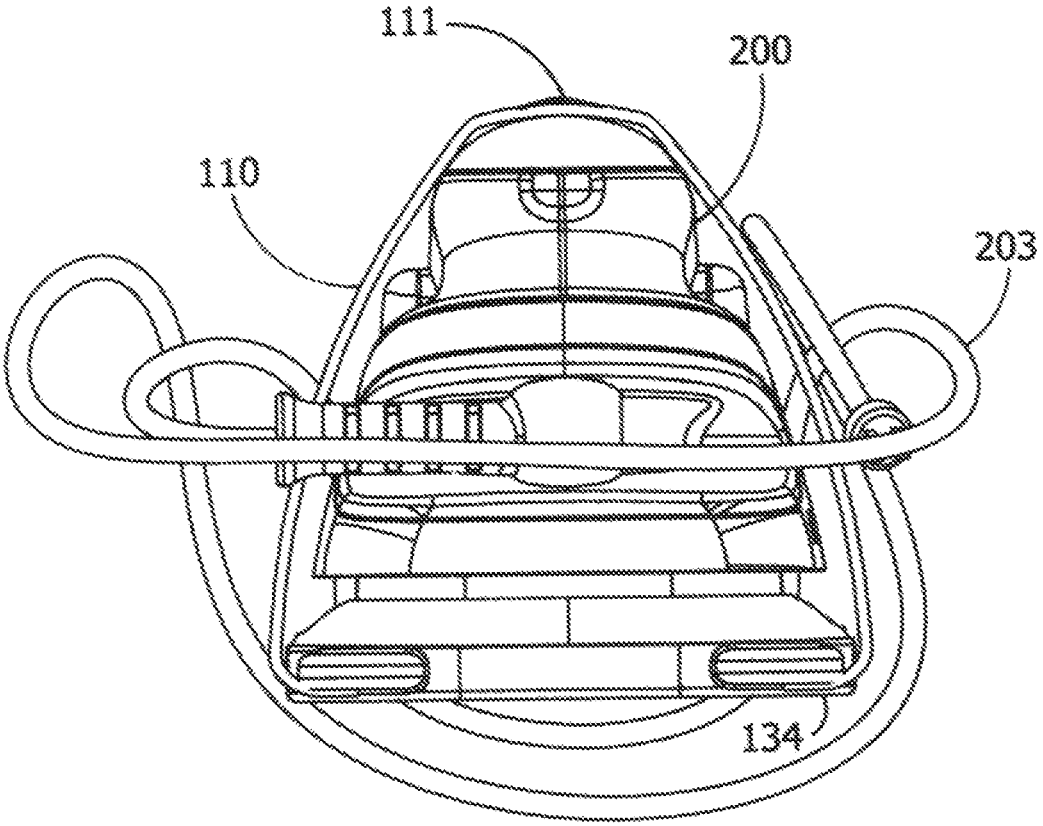
FIG. 18 continues the example of FIG. 17, showing a view toward a back end of the sole plate cover and iron.

Some embodiments of a sole plate cover provide cord wrap protrusions for neatly storing an iron's power cord without the cord coming into contact with a hot sole plate. Contact between the iron's power cord and the hot sole plate could damage the cord and cause a safety hazard. FIG. 17 shows a pictorial view of an example of a steam iron 200 firmly attached to a sole plate cover 100, with the iron's electric power cord 203 wrapped around the back end of the iron and around two cord wrap projections 109 near the front end of the sole plate cover. FIG. 18 continues the example of FIG. 17, showing a view toward the back end of the iron and sole plate cover 100. The cord wrap projections at the front end of the sole plate cover 100 prevent the wrapped cord 203 from slipping down the tapered arcuate sides of the sole plate and sole plate cover, enabling neat, safe, and secure storage of the electric power cord. As suggested in the example of FIG. 3, some embodiments of a sole plate cover 100 have two more cord wrap projections 109 at opposite rear corners (142, 144) of the cover.

Figure 19:
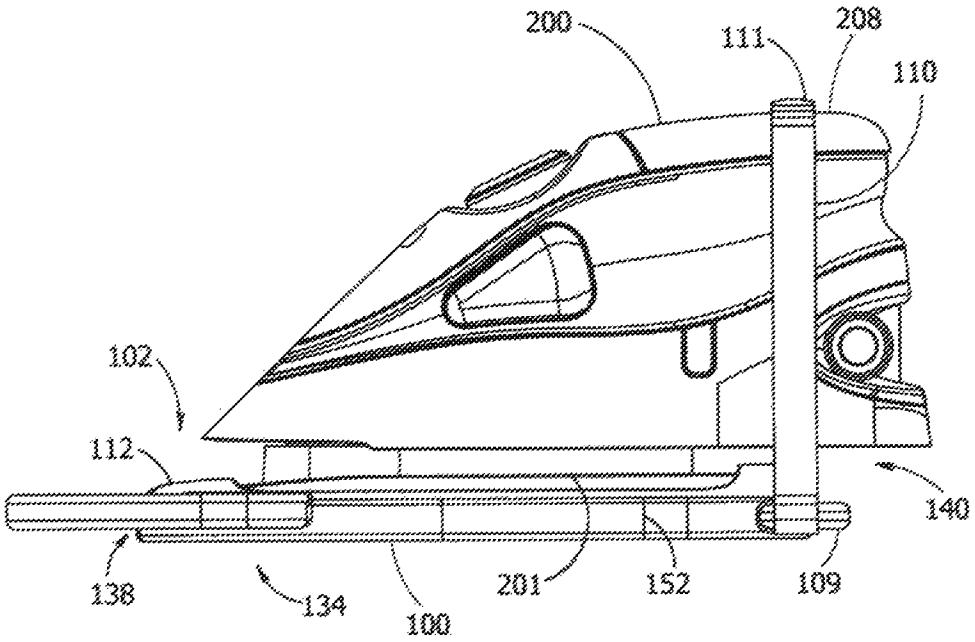
FIG. 19 shows a view toward a left side of the example embodiment of a sole plate cover from the previous figures, with an example of a flexible strap and pressure relief valve for preventing leakage from a water storage tank in the iron.
Figure 20:
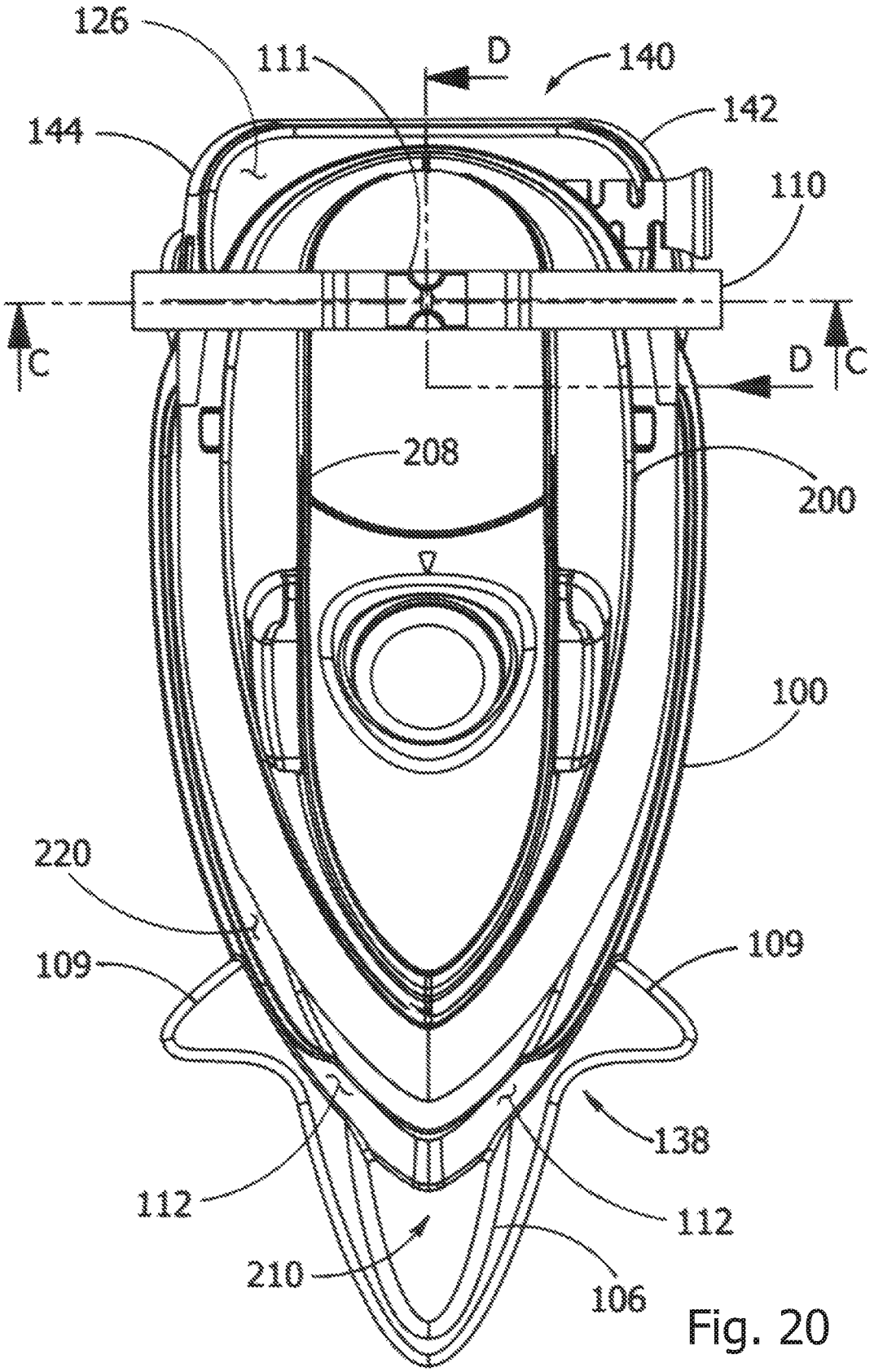
FIG. 20 continues the example of FIG. 19, showing a view toward the top of the steam iron and further showing an example of a pressure relief valve on the flexible strap.

FIG. 19 shows a view toward a left side of an iron 200 firmly attached to an example embodiment of a sole plate cover 100. FIG. 20 continues the example of FIG. 19, showing a view of the iron 200 toward the top side with the water tank cover 208 visible. FIGS. 19 and 20 illustrate examples of a flexible strap 110 in position to hold the water tank cover 208 closed and prevent leakage from a vent hole in the water tank cover. FIG. 20 further illustrates examples of the top surface 220 of the sole plate of the electric steam iron 200, the bluntly pointed front end 210 of the sole plate of the iron held under the front sole plate retaining flange 112, and the back end of the sole plate held under the rear sole plate retaining flange 126 extending to opposite rear corners (142, 144) of the sole plate cover 100.

Figure 21:
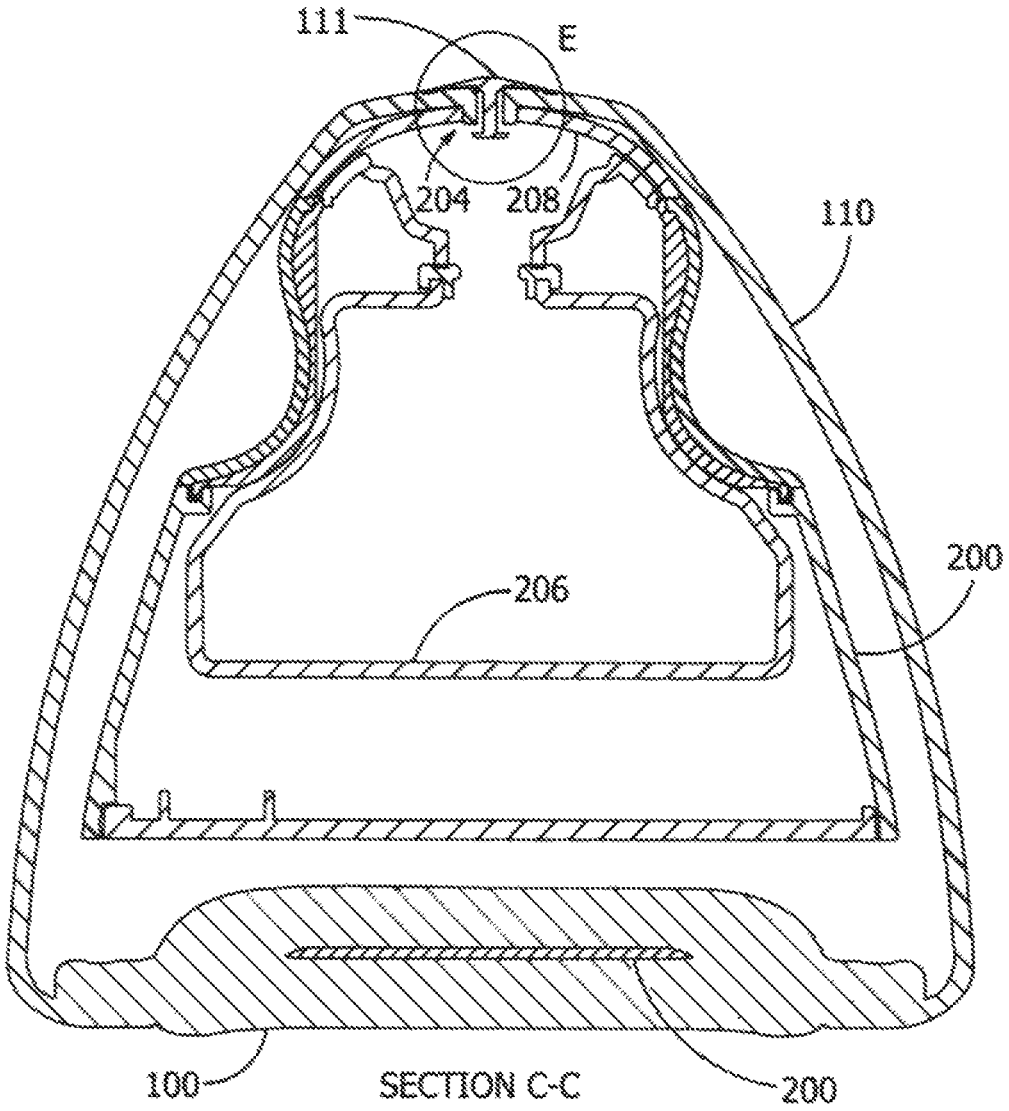
FIG. 21 is a lateral cross-sectional view C-C showing examples of a water tank and a vented water tank cover, with an example pressure relief valve in place to prevent leakage from the water tank through the vent hole in the water tank cover.
Figure 22:
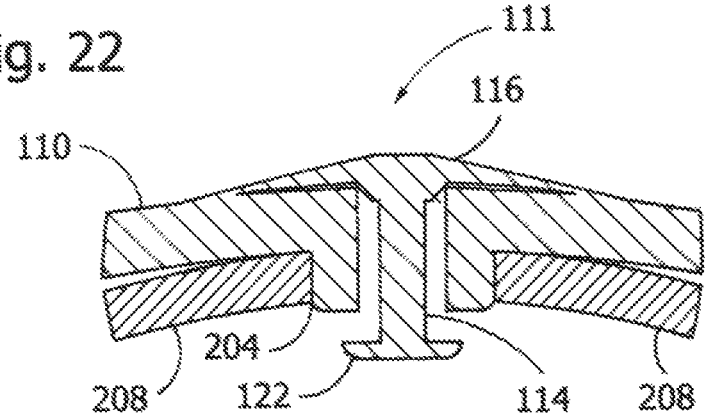
FIG. 22 shows a detail view E from FIG. 21, showing an example of the pressure relief valve in a closed position to prevent water leaking through the vent hole in the water tank cover.
Figure 23:
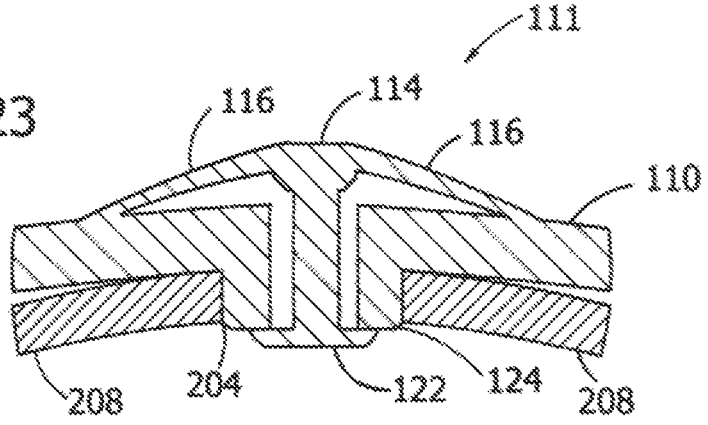
FIG. 23 continues the example of FIG. 22, showing an alternative position of the vent plug in the pressure relief valve to allow the escape of excess pressure in the water storage tank.
Figure 24:
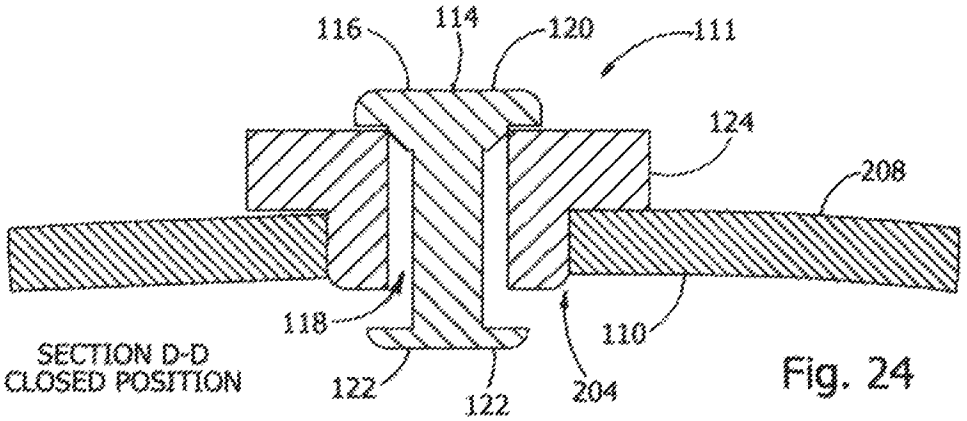
FIG. 24 shows a partial cross-sectional view D-D illustrating an example of the closed position of the pressure relief valve.
Figure 25:
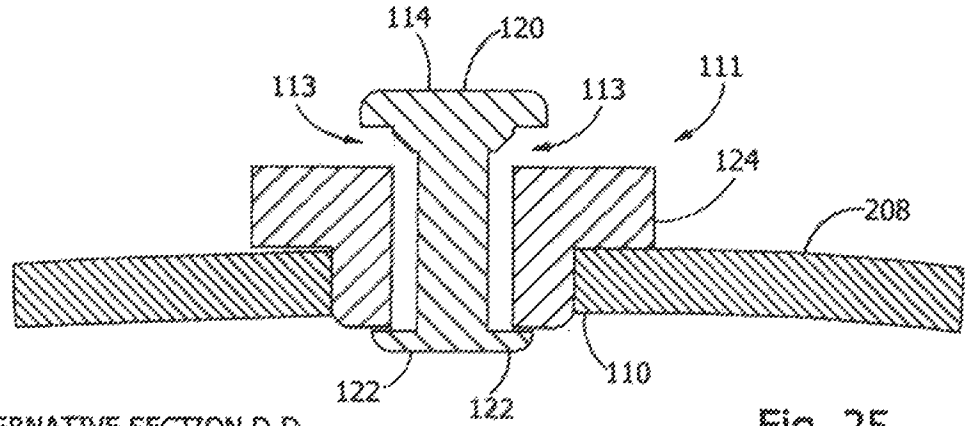
FIG. 25 continues the example of FIG. 24, illustrating an example of the open position of the pressure relief valve.

Some details of an example of a water tank 206, water tank cover 208, and pressure relief valve 111 are shown in the cross-sectional view C-C of FIG. 21. The flexible strap 110 passes over the water tank cover 208, holding the water tank cover closed to prevent water spillage from the water tank 206 when the iron is stored. The strap 110 holds the optional pressure relief valve 111 against the water tank cover to block a water tank vent aperture 204 formed in the water tank cover 208. The pressure relief valve prevents water leakage through the water tank vent aperture 204 but opens to vent the water tank 206 in the event of excessive pressure buildup in the water tank.

FIGS. 22, 23, 24, and 25 show examples of a pressure relief valve 111 in cross-sectional views. The water tank cover 208 may be formed with a water tank vent aperture 204. A valve body 124 sized for a close sliding fit into the water tank vent aperture includes a valve plug 114 slidably engaged with the valve body through a plug aperture 118 formed in the valve body. A flexible web 116 attached to an outer end of the valve plug 114 functions as a spring and a seal, urging the valve plug toward the water tank as suggested in the example of FIG. 22. When the web 116 is flat against the flexible strap 110 as suggested in FIG. 22 and FIG. 24, vent apertures 113 formed in the web are closed against the surface of the strap 110, thereby prevent water vapor and liquid water from escaping out of the water tank vent aperture 204 through the plug aperture 118 and vent apertures 113. Should sufficient pressure build up in the water tank in the iron to overcome the spring force of the flexible web 116, the valve plug 114 is forced outward, opening a fluid path from the water tank, through the plug aperture 118 in the valve body 124, through the vent apertures 113 in the web 116, and to the outside atmosphere as suggested FIG. 25. Tabs or a cap 122 at an end of the valve plug 114 prevent the valve plug 114 from separating from the valve body by pressure in the water tank. Another cap or tabs 120 at an opposite end of the valve plug 114 prevent the valve plug from being drawn too far into the water tank through the water tank vent aperture 204.

Figure 26:
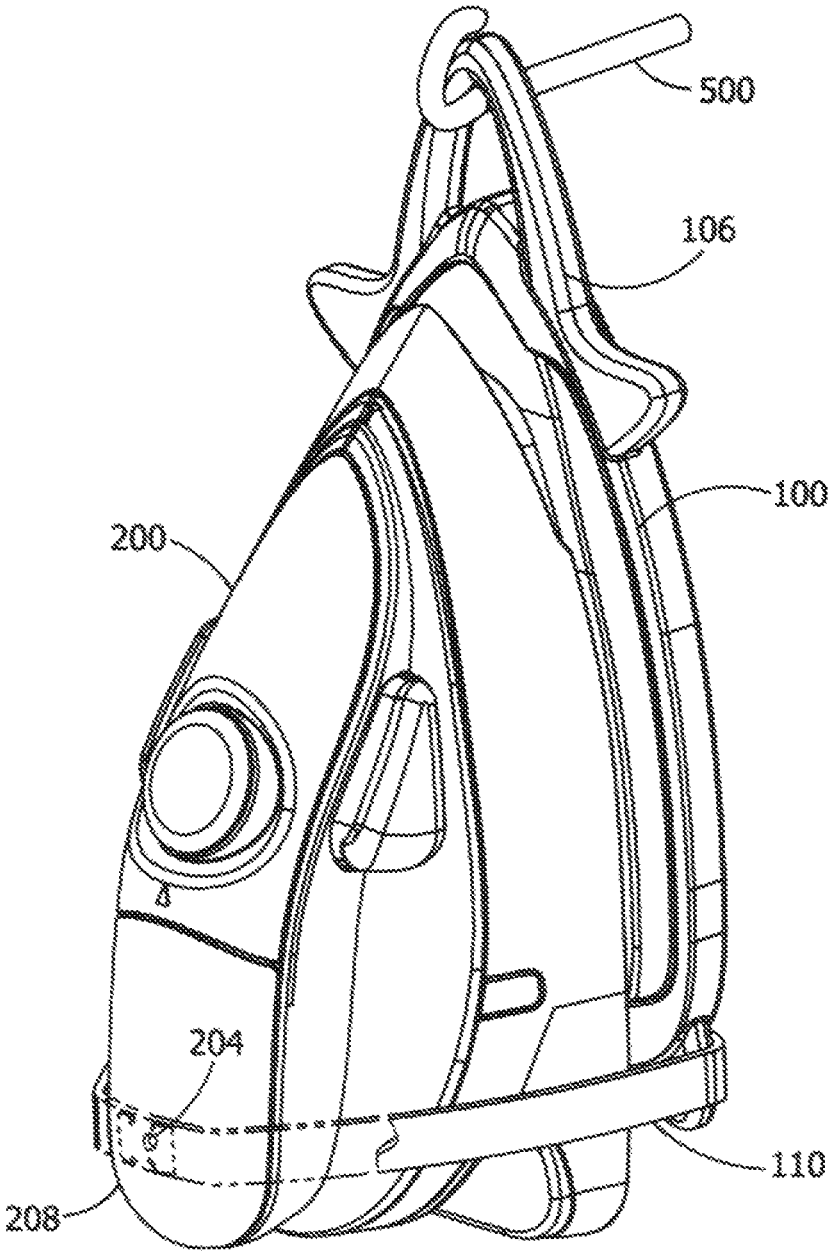
FIG. 26 shows a pictorial view of an example of a sole plate cover embodiment attached on its storage side to the sole plate of an example steam iron, with the steam iron and sole plate cover suspended from a hook by a loop formed at the front of the sole plate cover.

FIG. 26 shows an example of an iron 200 attached to the storage side of a sole plate cover 100 with the sole plate cover 100 and iron suspended by the hanging loop 106 from an example of a hook 500 attached to a wall or other vertical surface. The flexible strap 110 holds down the water tank cover to prevent water spillage from an open cover. The optional pressure relief valve on the strap blocks leakage of vapor and liquid from the water tank vent aperture 204. Liquid and vapor leakage through the steam vents in the sole plate and contact with hot surfaces of the sole plate on the iron are effectively and safely prevented by the sole plate cover 100.

Figure 27:
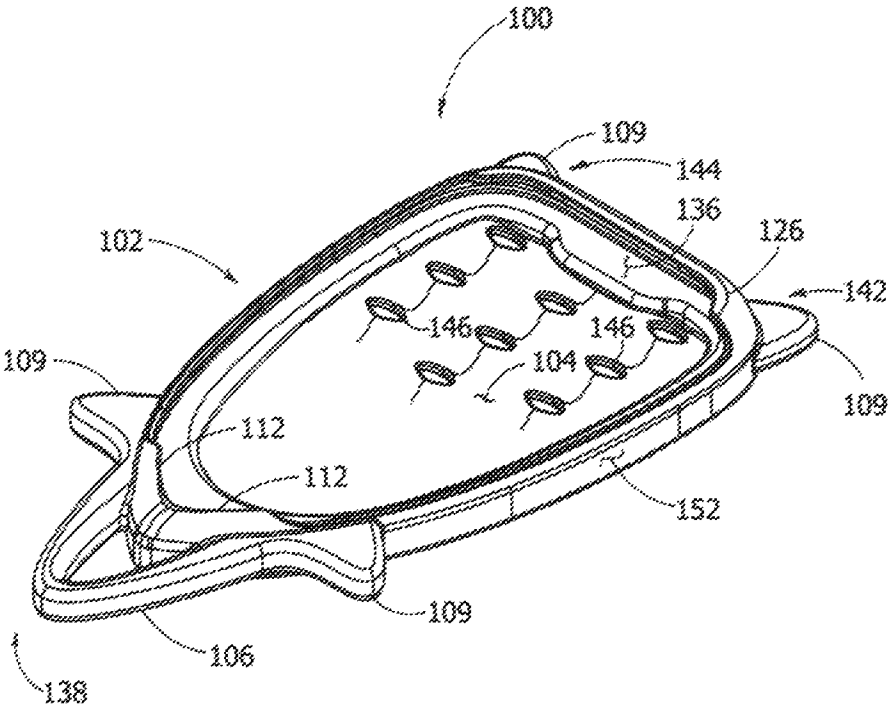
FIG. 27 shows a pictorial view of an example alternative embodiment of a sole plate cover.
Figure 28:
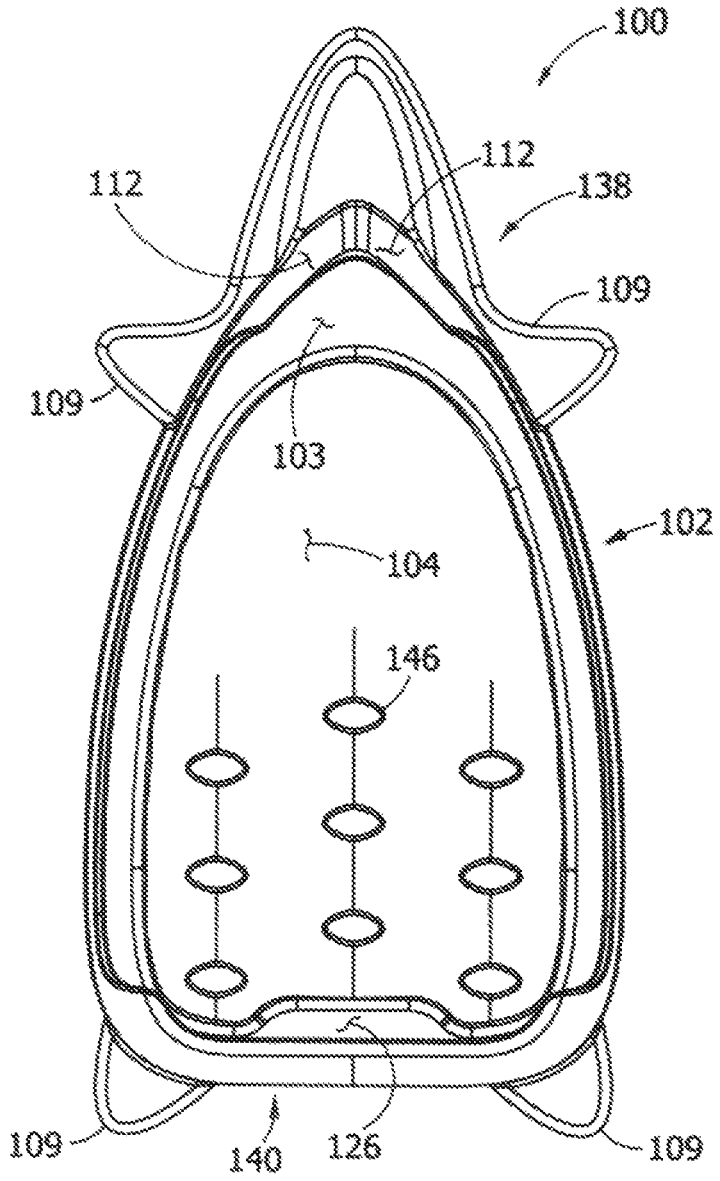
FIG. 28 shows a view toward the storage side of the alternative sole plate cover embodiment of FIG. 27.

An example of an alternative embodiment of a sole plate cover 100 is shown in FIG. 27 and FIG. 28. The example of a sole plate cover 100 in FIGS. 27-28 omits the flexible strap 110, pressure relief valve 111, some vent apertures 146, and vent plugs 105 of previously described embodiments, retaining the flanges (112, 126), side walls 152, sole plate grip 150, and other features.

Figure 29:
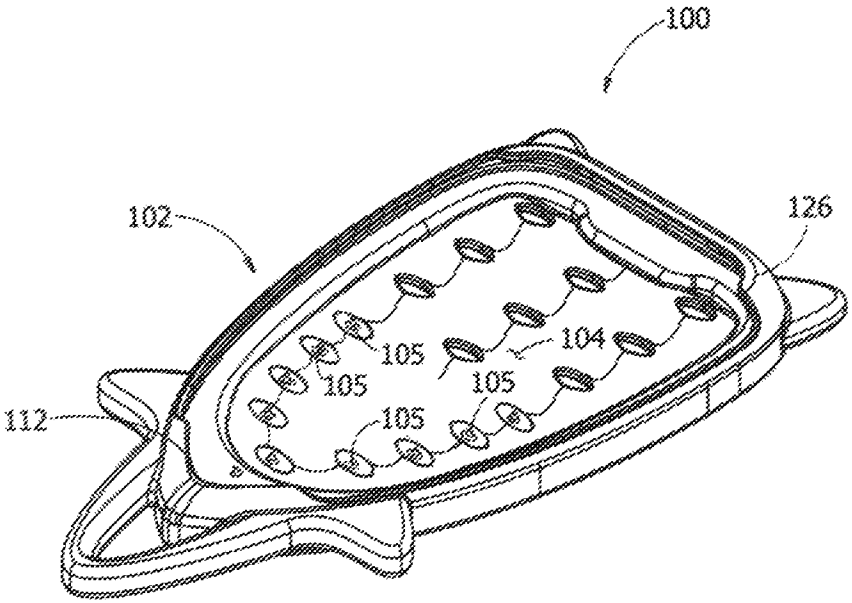
FIG. 29 shows a pictorial view of an example of another alternative embodiment of a sole plate cover having a plurality of vent plugs arranged along an arcuate path.
Figure 30:
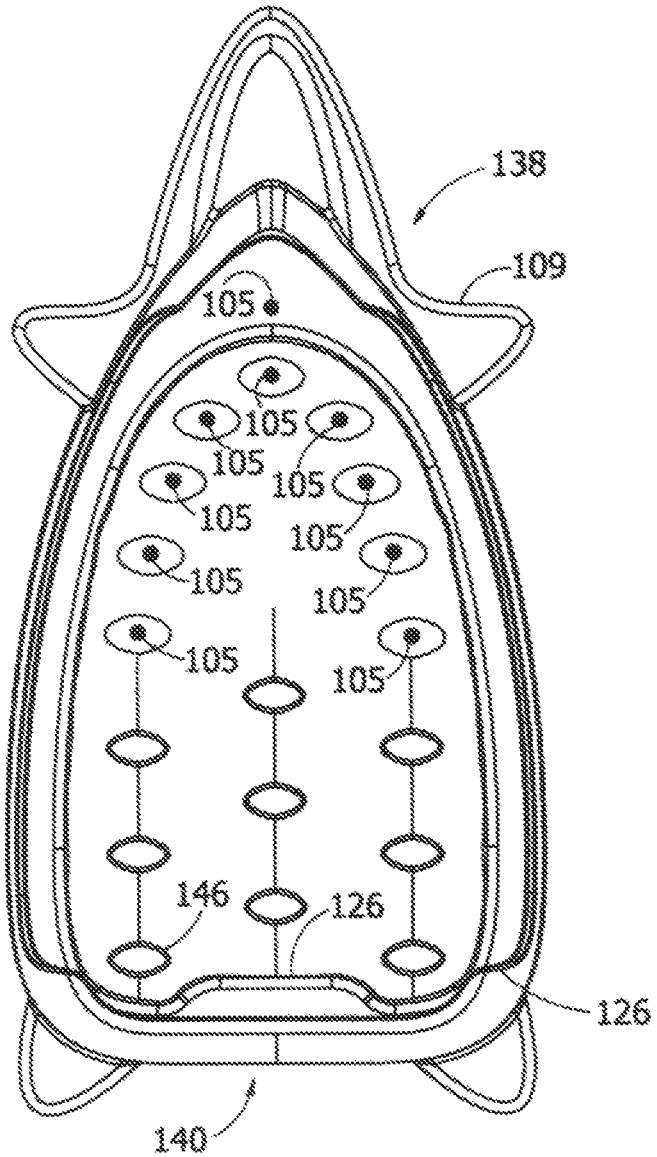
FIG. 30 shows a view toward the storage side of the alternative sole plate cover embodiment of FIG. 29.

An example of another alternative embodiment of a sole plate cover 100 is shown in FIG. 29 and FIG. 30. The example sole plate cover 100 in FIGS. 29-30 includes a plurality of vent plugs 105 arranged along an arcuate path, each vent plug positioned to seal a correspondingly positioned steam vent on the sole plate of a steam iron.

Silicone rubber is an example of a material suitable for making any of the embodiments 100 disclosed herein. In a preferred embodiment of a sole plate cover 100, the material is selected to withstand a temperature of at least 400 degrees Fahrenheit (204 degrees Celsius) without scorching, burning, substantial discoloration, or substantial loss of flexibility and/or elasticity.

An example of a method embodiment includes any one or more of the following steps, in any combination or subcombination: inserting a front end of a sole plate for a steam iron between a flexible plate and a front sole plate retaining flange on a sole plate cover; inserting a corner at a back end of the sole plate between the flexible plate and a rear plate retaining flange on the sole plate cover; positioning a vent plug on the flexible plate to block a steam vent on the sole plate; placing a flexible strap attached to the sole plate cover over a water tank cover on the iron, thereby holding the water tank cover closed; and closing a vent hole on the water tank cover with a pressure relief valve attached to the flexible strap.

Unless expressly stated otherwise herein, ordinary terms have their corresponding ordinary meanings within the respective contexts of their presentations, and ordinary terms of art have their corresponding regular meanings.

What is claimed is:

1. A sole plate cover, comprising:

a flexible plate;

a flexible sidewall extending outward from said flexible plate;

a front sole plate retaining flange attached to a front end of said flexible sidewall; and a vent plug extending outward from a storage side of said flexible plate, said vent plug positioned to block a steam vent on a sole plate of a steam iron.

2. The sole plate cover of claim 1, further comprising a rear sole plate retaining flange attached to a back end of said flexible sidewall.

3. The sole plate cover of claim 1, further comprising a cord wrap projection extending outward from said flexible sidewall.

4. The sole plate cover of claim 1, further comprising a second of said vent plug extending outward from said storage side, said second vent plug positioned to block another steam vent on the sole plate.

5. The sole plate cover of claim 1, further comprising a plurality of flexible domes extending outward from said storage side.

6. The sole plate cover of claim 5, wherein said vent plug extends outward from one of said flexible domes.

7. The sole plate cover of claim 1, further comprising a flexible strap attached to said sole plate cover.

8. The sole plate cover of claim 7, further comprising a pressure relief valve attached to said flexible strap, said pressure relief valve positioned to block a water tank vent aperture on a steam iron.

9. The sole plate cover of claim 8, wherein said pressure relief valve comprises:

a valve body attached to said flexible strap;

a valve plug slidably engaged with an aperture formed in said valve body; and a flexible web attaching a first end of said valve plug to said valve body, wherein a second end of said valve plug is positioned to block the water tank vent aperture.

10. The sole plate cover of claim 9, wherein said flexible web is positioned to urge said valve plug toward the water tank vent aperture.

11. The sole plate cover of claim 1, wherein said flexible sidewall further comprises a sole plate grip positioned to contact a top surface of a sole plate on a steam iron.

12. The sole plate cover of claim 1, further comprising a cord wrap projection extending outward from said sole plate cover.

13. The sole plate cover of claim 1, wherein said flexible plate is formed with an undulating surface.

14. The sole plate cover of claim 1, wherein said flexible plate is formed with a plurality of vent apertures extending from a storage side to a resting side of said flexible plate.

15. An apparatus for covering a sole plate of a steam iron, comprising:

a flexible plate;

a flexible sidewall extending outward from said flexible plate;

a front sole plate retaining flange attached to a front end of said flexible sidewall;

a rear sole plate retaining flange attached to a back end of said flexible sidewall;

a vent plug extending outward from a storage side of said flexible plate;

a flexible strap attached to said flexible sidewall; and a pressure relief valve attached to said flexible strap, said pressure relief valve positioned to block a water tank vent aperture formed in a water tank cover on the steam iron, said pressure relief valve comprising:

a valve body attached to said flexible strap; and a valve plug slidably engaged with said valve body.

16. A method, comprising:

inserting a front end of a sole plate for a steam iron between a flexible plate and a front sole plate retaining flange on a sole plate cover;

inserting a corner at a back end of the sole plate between the flexible plate and a rear plate retaining flange on the sole plate cover; and positioning a vent plug on the flexible plate to block a steam vent on the sole plate.

17. The method of claim 16, further comprising placing a flexible strap attached to the sole plate cover over a water tank cover on the iron, thereby holding the water tank cover closed.

18. The method of claim 17, further comprising closing a vent hole on the water tank cover with a pressure relief valve attached to the flexible strap.

* * * * *